United States Patent [19]

Wörner et al.

[11] Patent Number: 4,576,799

[45] Date of Patent: Mar. 18, 1986

[54] FILTERING AND POST-COMBUSTION DEVICE FOR WASTE GASES

[75] Inventors: Siegfried Wörner, Esslingen; Walter Öttle, Faurndau; Herbert Klein, Altbach, all of Fed. Rep. of Germany

[73] Assignee: J. Eberspächer, Fed. Rep. of Germany

[21] Appl. No.: 518,033

[22] Filed: Jul. 28, 1983

[30] Foreign Application Priority Data

Jul. 29, 1982 [DE] Fed. Rep. of Germany ..... 3228325

[51] Int. Cl.[4] ..... B01J 8/04

[52] U.S. Cl. ..... 422/176; 55/330; 55/484; 55/DIG. 30; 60/299; 422/179; 422/181

[58] Field of Search ..... 422/171, 179, 180, 181, 422/176, 221, 218, 222, 192; 55/DIG. 30, 484, 330; 60/299; 423/213.2

[56] References Cited

U.S. PATENT DOCUMENTS

| | | | |
|---|---|---|---|
| 2,574,053 | 11/1951 | McGowan | 55/484 |
| 3,246,961 | 4/1966 | Karlsson | 422/192 |
| 3,649,214 | 3/1972 | Henriksson et al. | 422/181 |
| 3,806,322 | 4/1974 | Tabak | 422/180 X |
| 3,957,445 | 5/1976 | Foster | 422/179 X |
| 4,004,888 | 1/1977 | Musall et al. | 422/179 |
| 4,039,294 | 8/1977 | Mayer et al. | 55/DIG. 30 |
| 4,175,107 | 11/1979 | Iwaoka et al. | 422/181 X |
| 4,264,561 | 4/1981 | Geodicke | 60/299 X |

FOREIGN PATENT DOCUMENTS

| | | | |
|---|---|---|---|
| 145941 | 1/1981 | German Democratic Rep. | 60/299 |
| 522334 | 7/1976 | U.S.S.R. | 422/181 |

*Primary Examiner*—Barry S. Richman
*Assistant Examiner*—William R. Johnson
*Attorney, Agent, or Firm*—McGlew and Tuttle

[57] ABSTRACT

A filtering and post-combustion device for waste gases, particularly of internal combustion engines, is designed with a plurality of filtering elements which are mounted at equally spaced radial locations within a circular or oval housing and are radially transversable by the gas stream which enters and leaves axially through funnels. At the inner filtering elements, the outlet chambers are separated from the adjacent inlet chambers of the respective following filtering element by axially extending walls. Each individual filtering element comprises a perforated retaining shell, a filter body, such as a wire mesh, permeable to gas, and a perforated supporting wall.

9 Claims, 2 Drawing Figures

FILTERING AND POST-COMBUSTION DEVICE FOR WASTE GASES

FIELD AND BACKGROUND OF THE INVENTION

The present invention relates to a device for removing solid particles from waste gases, particularly exhaust gases of internal combustion engines, and subjecting them to a catalytic post-combustion.

Such devices are known in a variety of designs. They all have the disadvantage of effecting the needed soot separation in an unsatisfactory manner, so that the catalytically acting substance becomes very soon ineffective. In addition, the devices are usually complicated in design and require much space.

SUMMARY OF THE INVENTION

The invention is directed to a device of this kind which is inexpensive and space saving and completely satisfactory in separating soot from the waste gases to the required extent.

In accordance with the invention the filtering and post-combustion device for waste gases particularly for internal combustion engines comprises a housing having one end with an inlet and an opposite end with an outlet and containing axially spaced inlet and outlet end plates or tube sheets which have respective inlet and outlet openings. A plurality of cylindrical filtering elements of different diameters are arranged one within the other and within the housing between the end plates and each includes an axially extending filter which are held between perforated walls in order to permit radial flow of the gases therethrough. In addition a separation wall extends between one radial side of at least one of the filters and the opposite radial side of the next adjacent filter in an arrangement to permit flow from the inlet openings into the space defined on one side of the filter and through the filter to the opposite radial side and thence to the outlet openings. The filter comprises a filtering body of a wire mesh or ceramic fiber tangle which is permeable to the gas and which is supported by a perforated supporting shell.

The transverse bottoms are tightened together by means of a straining bolt which may be surrounded by a centric tube, preferably with an interposed spring, to compensate for thermal expansions. The inlet funnel and/or the outlet funnel are detachably connected to the housing by means of a fastening element known per se, such as a strap, with the interposition of a gasket.

This design results in the best utilization of space for filtering and post-combustion purposes. The exhaust gas stream is uniformly distributed among a plurality of filtering elements and supplied thereto, as well as taken off, over the entire area. The filtering elements may be removed for cleaning or exchange. With a substantially identical design, a plurality of filtering elements may be assembled in series to intensify their effect; this may be done in the same direction, or countercurrently.

The innermost filter and the centric tightening tube enclose a cylindrical, annular inlet chamber if the gas flows radially outwardly, or an outlet chamber if the gas flows radially inwardly. Consequently, the outermost filtering element and the housing form therebetween a cylindrical, annular outlet chamber or inlet chamber, respectively.

In an above mentioned series connection in the same direction, two filtering elements are mounted radially spaced within each other while forming a cylindrical intermediate chamber having a circular or oval cross-section.

If, as mentioned above, the filtering elements are connected countercurrently, two groups of filtering elements are accommodated in a single housing and separated from each other by an intermediate transverse wall or plate having throughholes; the throughholes establish communication between the outlet chamber of an inlet filtering element and the inlet chamber of the following filtering element.

The filling of the filtering bodies, thus the wire mesh or ceramic fiber tangle, may be coated to be catalytically effective. The filling is received between the retaining shell and the supporting shell. It may be designed as a body having a permanent shape. Also, the filtering bodies may be helically wound, for example of flat strips. Further, the inlet chambers and, in double filtering elements, the intermediate chambers may be filled, at least partly, with a substance catalytically supporting the post-combustion, or with a material, for example wire mesh, coated with such a substance, or the retaining shells may carry a layer, for example a helically wound one, of, or with, a substance which is catalytically effective in the post-bombustion. Such layers should become effective at about 200° C., while the filling proper of the filtering bodies should become effective above about 400° C. This is very instrumental in preserving the filtering bodies.

Accordingly it is an object of the invention to provide a device for treating exhaust gases which includes a plurality of nested annular filter elements within a housing screen so that flow through the housing of the exhaust gases to be treated is axial in the spaces between the filter elements and radially through the filters and out the other end of the housing.

A further object of the invention is to provide a device for treating exhaust gases which includes a housing having axially elongated filter elements which advantageously include a composition for facilitating further burning and withdrawal of dust and dirt from the gases.

A further object of the invention is to provide a device for treating exhaust gases which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

GENERAL DESCRIPTION OF PREFERRED EMBODIMENTS

Figure 1:
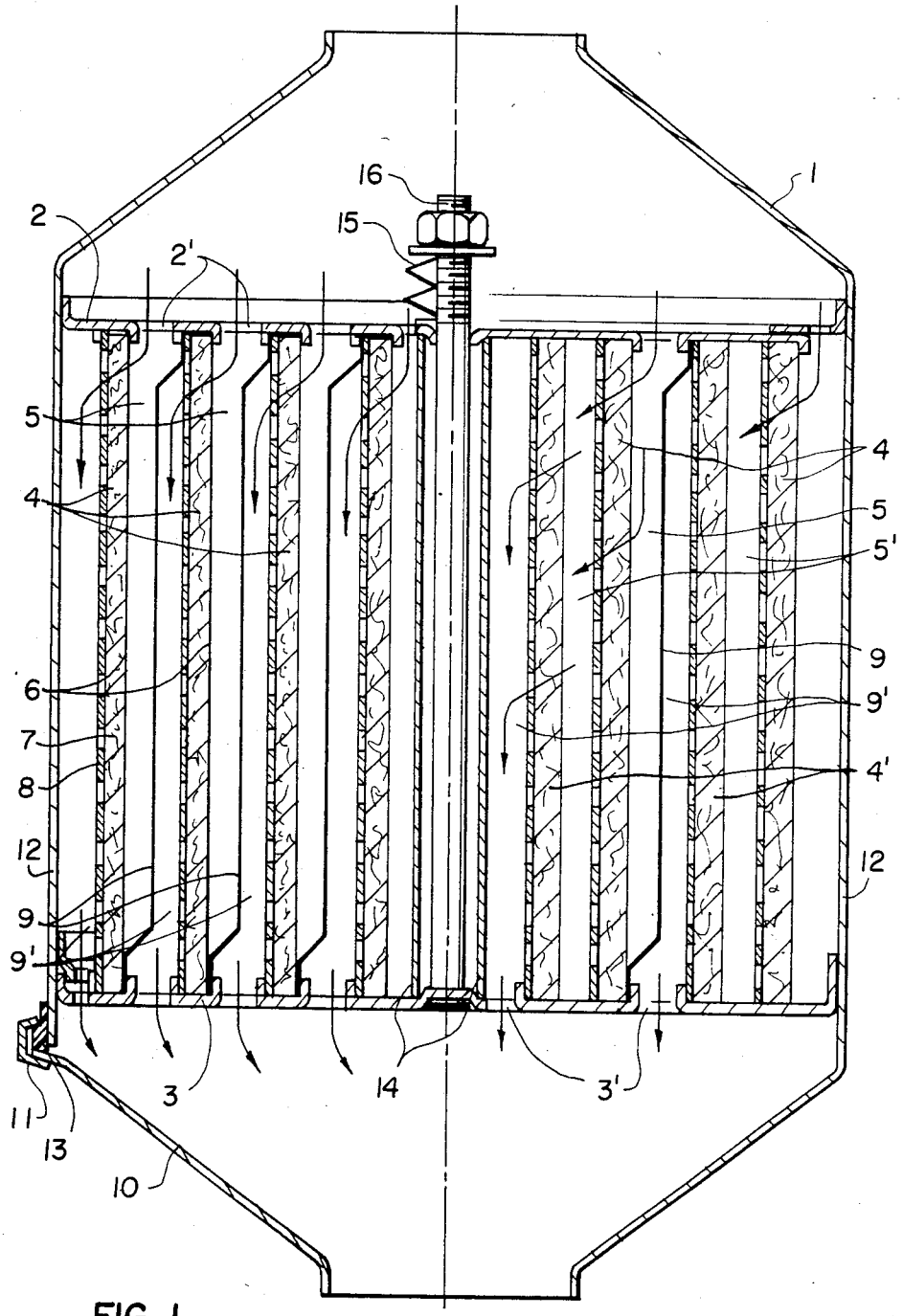
FIG. 1 is a longitudinal sectional view showing on the left of the center line an inventive filtering and post-combustion device comprising a plurality of filtering elements which are mounted in parallel and traversed by the gas stream radially outwardly, and on the right hand side of the center line double filtering elements being traversed by a gas stream radially inwardly.

Referring to the drawings in particular, the invention embodied therein comprises a filtering and post-combustion device for waste gases which includes a housing having one end with an inlet in the form of an inlet funnel 1, and an opposite end with an outlet in the form of an outlet funnel 10. Axially spaced inlet and outlet end plates 2 and 3 which have respective inlet openings 2' and outlet openings 3' are arranged within the housing. A plurality of cylindrical filtering elements 4 of different diameters are arranged one within the other and within the housing between the end plates 2 and 3 and each include a central axially extending filter 7 which is held between perforated wall means in the form of a perforated shell 6 and a perforated wall 8. The arrangement permits radial flow of the exhaust gases through the filter 7. The construction includes a wall 9 extending between one radial side of at least one of the filters 7 and an opposite radial side of the next adjacent filter 7 at the opposite end thereof to permit a flow from the inlet openings into the space on one side of each filter and then through the filter radially to the opposite side and to the outlet openings 3'.

Advantageously the filtering body comprises a wire mesh or ceramic fiber tangle permeable to gas supported within a perforated supporting shell.

According to FIG. 1 as shown to the left of the center line within a tubular housing 12 having a circular or oval cross-section, a plurality of cylindrical filtering elements 4 is mounted between a transverse inlet end plate 2 having inlet apertures 2' and secured to an inlet funnel 1, and a transverse outlet end plate 3 having outlet apertures 3' and secured to an outlet funnel 10. The filtering elements have a circular or oval cross-section corresponding to that of the housing, and they are disposed to extend axially with an equidistant radial spacing. A wall 9 of a similar cross-section is provided midway between every two filtering elements. Inlet chambers 5 and outlet chambers 9' of equal radial width and having circular or oval cross-sections are thereby formed. The innermost filtering element 4 together with a tightening tube 14 extending between the transverse end plates form the innermost inlet chamber 5, while the outermost filtering element along with the housing form the outermost outlet chamber 9'. Inlet and outlet apertures 2', 3' are aligned with inlet and outlet chambers 5, 9'. It is noted that wall 9 has an upper portion which is bent in one direction and at an angle to the axis of the housing so as to partly cover one inlet opening of inlet end plate 2. The same wall 9 has a lower end bent in an opposite direction to partly cover an outlet opening of the outlet end plate 3, which is aligned with the inlet opening at the top but which is separated from that inlet opening by the wall 9. In this way communication is established only between an inlet opening in plate 2 and an outlet opening in plate 3 which is not aligned with the inlet opening.

Filtering elements 4 comprise a perforated retaining shell 6, the filtering body 7 made of a wire mesh or ceramic fiber tangle and permeable to gas, and a perforated supporting shell 8. The filtering body may be coated with a substance catalytically assisting the post-combustion. Inlet chambers 5 may be filled completely or partly with such a catalytically effective material, for example with a coated wire mesh. Such a material may even be carried by retaining shells 6, for example in the form of a helically wound layer.

The transverse bottoms are tightened together by a straining bolt 16 which is surrounded by a tightening tube 14 against which it bears through a spring 15 compensating for thermal expansion. In the shown example, the inlet funnel is integral with the housing, while the outlet funnel is secured to the housing detachably, by means of a strap 11 and with an interposed gasket 13.

The waste gases flow from inlet funnel 1 through apertures 2' of transverse bottom 2 into the individual inlet chambers 5 where they are distributed over the entire area of filtering elements 4. The gases then penetrate through the filtering element, radially outwardly according to FIG. 1, enter the adjacent outlet chambers 9', again over the entire area of the filtering elements, and flow therefrom through apertures 3' of transverse bottom 3 and through outlet funnel 10 to the outside.

FIG. 1 shows a modification where two inner filtering elements 4, 4' are arranged within two outer cylindrical filtering elements 4, 4' coaxially and with an equidistant radial spacing so that they enclose cylindrical intermediate chambers 5' having a circular or oval cross-section, and form a double filtering element. In the shown embodiment, the gases flow radially inwardly.

Figure 2:
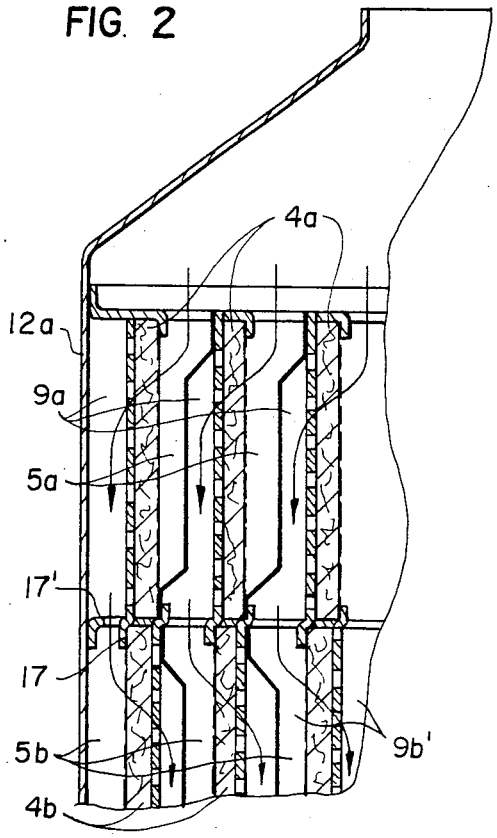
FIG. 2 is a similar showing where in a first part, the gas stream traverses the filtering elements radially outwardly and in a following second part, radially inwardly.

In FIG. 2 another modification is shown comprising a housing **12*a* accommodating inlet filtering elements 4*a* through which the gases flow radially outwardly, and axially following outlet filtering elements 4*b* through which the gases flow radially inwardly. Therebetween, an intermediate transverse bottom 17 is provided having througholes 17' by which communication is established between outlet chambers 9*b'* of filtering elements 4*b* and inlet chambers 9*a* of the following filtering elements 4*a***.

While specific embodiments of the invention have been shown and described in detail to illustrate the application of the principles of the invention, it will be understood that the invention may be embodied otherwise without departing from such principles.

What is claimed is:

1. A filtering and post-combustion device for cleaning soot from waste gases of an internal combustion engine, comprising a housing having one frusto-conical shaped end with an inlet and an opposite frusto-conical shaped end with an outlet which is axially spaced from said inlet, axially spaced inlet and outlet end plates arranged within said housing having means defining a plurality of respective axially aligned inlet and outlet openings therethrough, a plurality of hollow cylindrical filtering elements of different diameters arranged coaxially and at equal radial distances one within the other and within said housing between said end plates, each filtering element including a central gas permeable, axially extending filter and perforated wall means holding said filter in an arrangement permitting radial flow through said filter, and an axially extending wall extending midway between a first radial side of at least one of said filters to an opposite second radial side of a next adjacent filter and from a first axial end of said one filter to an opposite second axial end of said next adjacent filter, said wall defining an annular inlet chamber on said first radial side thereof which communicates with at least one of said inlet openings and an annular outlet chamber on said second radial side thereof which communicates with at least one of said outlet openings which is not axially aligned with said at least one inlet opening so as to further define a flow path from said inlet opening to said inlet chamber and through said filter to said outlet chamber and to said outlet opening, said filter comprising a wire mesh or ceramic fiber material permeable to gas for filtering soot, said perforated wall means comprising a perforated retaining shell on said first radial side of each filter and a perforated support wall on said second radial side of each filter, said at least one inlet opening being separated from another outlet opening which is axially aligned therewith, by said axially extending wall.

2. A filtering and post-combustion device according to claim 1, wherein said axially extending wall has a first bent end which is bent at an angle with respect to a central axis of said housing so as to extend partly across said at least one inlet opening, said wall having a second bent end which is bent at an angle with respect to said central axis and extends partly across at least one outlet opening which is axially aligned with said at least one inlet opening.

3. A filtering and post-combustion device for waste gases according to claim 2, wherein said filter comprises a mesh material coated with a catalytic material.

4. A filtering and post-combustion device for waste gases according to claim 2 including a central tightening tube located coaxial to and within all of said filtering elements and extending between said end plates, and bolt means engaged with one of said end plates and having an adjusting nut threaded thereon for tightening said tube against the other of said end plates.

5. A filtering and post-combustion device for waste gas according to claim 2, wherein an outermost one of said filtering elements defines an annular chamber between said outermost element and said housing.

6. A filtering and post-combustion device for waste gases according to claim 2, including an intermediate transverse plate disposed between said inlet end plate and said outlet end plate and having openings therethrough for the passage of gases, wherein said axially extending wall extends from a first filter at a position adjacent to said first axial end to the next adjacent filter at a position adjacent said intermediate plate, further comprising a separating wall extending below said intermediate plate from said next adjacent filter at a position adjacent said intermediate plate to said first filter at a position adjacent said second axial end so as to define a flow path from said inlet to said outlet through a first portion of said filter in one radial direction and then radially back through a second portion of said filter in an opposite direction.

7. A filtering and post-combustion device for waste gases according to claim 2, wherein said perforated shell includes a catalytic layer for the post-combustion treatment of waste gases.

8. A filtering and post-combustion device for cleaning and removing soot from waste gases of an internal combustion engine comprising a housing having a cylindrical center portion with a frusto-conical shaped inlet at a first end and a frusto-conical shaped outlet at a second end, an inlet end plate having a plurality of inlet openings therethrough and which is mounted in said housing, an outlet end plate having a plurality of outlet openings and which is mounted in said housing adjacent said second end, a plurality of cylindrical filter assemblies disposed one within the other at equally spaced radial locations within said housing between said inlet end plate and said outlet end plate, means for tightening said inlet and outlet end plates against the ends of said filter elements, a dividing wall extending midway between at least two adjacent filter assemblies and being connected to one of the adjacent filter assemblies at a first end and to the next adjacent filter assembly at an opposite, second end, said filter assemblies each including a mesh portion for removing soot and a catalytic portion wherein said dividing wall divides the interior of said housing in such a manner so as to define a flow path therethrough from said inlet through an opening within said inlet end plate along the length of said filter assembly and radially through said filter assemblies to an outlet opening within said outlet end plate, wherein said opening of said inlet end plate is offset in a radial direction from said opening of said outlet end plate, further where said outlet end plate has at least one additional opening which is axially aligned with said opening of said inlet plate and separated from said opening of said inlet plate by said dividing wall, said dividing wall having an upper bent end which is bent at an acute angle with respect to a central axis of said housing and over a portion of said opening of said inlet end plate, and an opposite bent end which extends at an angle with respect to said central axis of said housing, and is overlying at least a portion of said at least one additional opening of said outlet end plate.

9. A filtering and post-combustion device for waste gases according to claim 8, including an intermediate plate extending radially through said housing and dividing the axial length of said filter assemblies with openings therethrough for the passage of gases between adjacent filter assemblies.

* * * * *